US006185968B1

(12) United States Patent
Kanamori

(10) Patent No.: US 6,185,968 B1
(45) Date of Patent: Feb. 13, 2001

(54) BENDING DEVICE AND BENDING METHOD

(75) Inventor: Takuya Kanamori, Seto (JP)

(73) Assignee: Kabushiki Kaisha Opton, Seto (JP)

( * ) Notice: Under 35 U.S.C. 154(b), the term of this patent shall be extended for 0 days.

(21) Appl. No.: 09/241,711

(22) Filed: Feb. 2, 1999

(30) Foreign Application Priority Data

Feb. 3, 1998 (JP) ..... 10-022192
Feb. 3, 1998 (JP) ..... 10-022193
Feb. 3, 1998 (JP) ..... 10-022194

(51) Int. Cl.[7] ..... B21D 7/12
(52) U.S. Cl. ..... 72/14.8; 72/306
(58) Field of Search ..... 72/306, 307, 149, 72/159, 388, 387, 14.8–15.1

(56) References Cited

U.S. PATENT DOCUMENTS 4,604,885 * 8/1986 Lang ..... 72/388
4,662,204 * 5/1987 Saegusa ..... 72/306
4,945,747 8/1990 Yogo ..... 72/306
5,627,132 * 5/1997 Rupoli ..... 72/306

FOREIGN PATENT DOCUMENTS

3620151 * 2/1987 (DE) ..... 72/306
93029 * 4/1987 (JP) ..... 72/307
267021 * 11/1987 (JP) ..... 72/307
513011 2/1993 (JP) .

* cited by examiner

*Primary Examiner*—Daniel C. Crane
(74) *Attorney, Agent, or Firm*—Davis and Bujold

(57) ABSTRACT

There is disclosed a bending device, in which working data of feeding pitch between bending points, bending direction angle and bending angle is prepared from design data of a work, and a dividing point is determined to share the bending process by first and second joint type robots at one place of a straight line of the work able to be held by a chuck mechanism. After trial working, the working data is corrected. During the working, the first and second joint robots having joints rotatable around axes parallel with the axial direction of the work are moved to the bending position The work is held by a bending die and a clamping die rotatable around the bending die of a bending mechanism attached to the tip end of each joint type robot, and bent/worked by rotating the clamping die. When moving to the next moving position, each joint is rotated to change the attitude of the bending mechanism, and the bending mechanism is moved along the work while the work remains between the bending die and the clamping die. After the bending process is completed, the work is held by the bending mechanism of the second joint type robot, moved in accordance with the angle of the bending mechanism of the first joint type robot in a direction in which the bending mehanism of the first joint type robot is not interfered with, and automatically moved to the unloading position.

20 Claims, 14 Drawing Sheets

BENDING DEVICE AND BENDING METHOD

BACKGROUND OF THE INVENTION

1. Field of the Invention

The present invention relates to a bending device and a bending method in which when a pipe, a bar material or another longitudinal work is bent/worked, two bending mechanism are moved to successively bend the work from its apposite ends toward its center.

2. Description of the Related Art

As disclosed in Japanese Patent Publication No. 13011/1993, a known conventional bending device is provided with a chuck mechanism for holding a pipe or a longitudinal work substantially by its center, two moving mechanisms which can move toward the center position along two tracks provided parallel on opposite sides of the work held by the chuck mechanism, and joint type robots mounted on the moving mechanisms and each having joints rotating around axes parallel with an axial direction of the work. In the bending device, attached to a tip end of each joint type robot is a bending mechanism in which the work is held by a bending die conformed to a bending shape of the work and a clamping die rotating around the bending die, and the work is bent by rotating the clamping die.

The bending process is performed by successively bending the work from its opposite ends toward its center while moving the joint type robots along the work.

In the conventional method, however, when the bending of one place is completed and the joint type robots are moved along the work, the bending mechanism is detached from the work before moving to the next bending position. After the movement, each joint of the joint type robot is rotated to move the bending mechanism in such a manner that the work is placed between the bending die and the clamping die of the bending mechanism, which causes a problem that the time necessary for working is lengthened.

Another problem is as follows:

When the work is bent in accordance with design data, in most cases, the work cannot be bent as designed because of differences in hardness and elongation of the work. To solve the problem, after trial working is performed, the differences from the design data are measured, the design data is corrected, and the work is again bent in accordance with the corrected design data. In most cases, the coordinate data of an imaginary point is given as the design data. For example, given as the design data are bending points as intersecton points which are obtained by extending the center lines of the adjacent straight portions of the work.

Since the bending points are imaginary, the bending points of the bent work cannot directly be measured. Therefore, after the distance between bending portions and the bending angle are measured in the bent work, the bending points are calculated from the measurement data. Moreover, since there are a large number of bending points, it cannot be easily known which bending point is to be corected when the design data differs from the measurement data. Specfically, if the data of one bending point is corrected, the correction has an influence on the other bending points, which causes a problem that the correcting operation is difficult.

The conventional bending device is further provided with an unloading device for detaching the bent work from the chuck mechanism for delivery after the bending process is completed. Since the work is delivered by the unloading device, the device is disadvantageously enlarged in because a space for installing the unloading device is necessary.

SUMMARY OF THE INVENTION

An object of the present invention is to provide a bending device by a joint type robot which can shorten working time.

Another object of the present invention is to provide a bending device in which working data can easily be corrected.

Further object of the present invention is to provide a bending device in which a work can easily be unloaded and delivered without enlarging device size.

To attain these and other objects, the present invention provides a bending device by a joint type robot in which the joint type robot having joints rotating around axes parallel with the axial direction of a longitudinal work is moved along the work, the work is held by a bending die and a clamping die rotatable around the bending die of a bending mechanism attached to a tip end of the joint type robot, and the work is bent by rotating the clamping die. The bending device is provided with a movement controller which moves the bending mechanism of the joint type robot along the work while rotating each joint to change the attitude of the bending mechanism and maintaining a state where the work remains between the bending die and the clamping die.

The bending device provides an effect that tact time can be shortened to shorten working time.

According to another aspect of the present invention, a bending device is provided with a chuck mechanism for holding a longitudinal work, first and second moving mechanisms which can move facing each other toward the chuck mechanism on two tracks provided parallel on opposite sides of the work held by the chuck mechanism, first and second joint type robots mounted on the first and second moving mechanisms and having joints rotating around axes parallel with the axial direction of the work) and bending mechanisms attached to tip ends of the first and second joint type robots for holding the work by a bending die and a clamping die rotatable around the bending die and bending the work by rotating the clamping die. The bending device is provided with a working data preparing unit for preparing working data of a feeding pitch between bending points, bending direction angle and bending angle from design data of the work of inputted orthogonal coordinate system.

The bending device is also provided with a controller for controlling the first and seond moving mecanisms and each joint of the first and second joint type robots based on the working data, and a corrector for correcting the working data in response to input.

According to the bending device, the working data can easily be changed after trial working.

The bending device may be provided with a dividing point determining unit for determining a dividing point in such a manner that a bending process is shared by the first and second joint type robots at one place of a straight portion of the work which can be held by the chuck mechanism.

According to further aepect of the present invention, a bending device is provided with a chuck mechanism for holding a longitudial work, first and second moving mechanisms which can move facing each other toward the chuck mechanism on two tracks provided parallel on opposite sides of the work held by the chuck mechanism, first and second joint type robots mounted on the first and second moving mechanisms and having joints rotatng around axes parallel with the axial direction of the work, and bending mechaisms attached to tip ends of the first and second joint type robots for holding the work by a bending die and a clamping die rotatable around the bending die and bending the work by rotatng the clamping die. The bending device is provided with an automatic delivery controller, by which after the bending process is completed, while the work is held by the bending mechanism of the second joint type robot, the work is moved to an unloading position in a manner that the bending mechanism of the first joint type robot does not interfere with the unloading path of the work.

Moreover, the bending device may be provided with a teaching delivery controller, by which the work is held by the bending mechanism of the first or second joint type robot and moved to the unloading position along a taught and stored moving path.

Furthermore, in addition to the teaching delivery controller, a determining unit may be provided for selecting the automatic delivery controller and the teaching delivery controller.

The bending device obviates the necessity of an optional unloading device. Therefore, the bent work can be delivered to the loading position without enlarging the device installation space.

BRIEF DESCRIPTION OF THE DRAWINGS

An embodiment of the present invention will be described with reference to the accompanying drawings, in which.

DETAILED DESCRIPTION OF PREFERRED EMBODIMENT

An embodiment of the present invention will be described hereinafter in detail with reference to the drawings.

Figure 1:
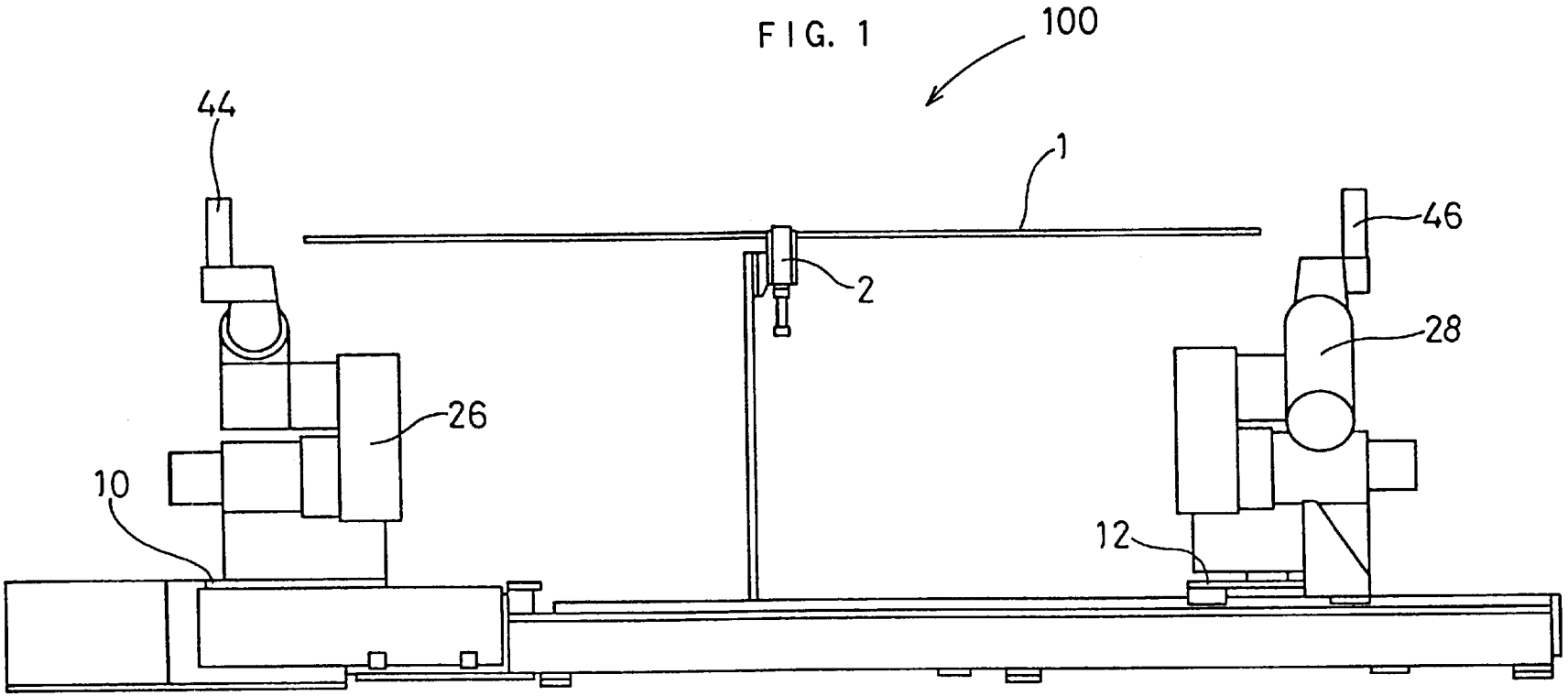
FIG. 1 is a front view of a bending device according to one embodiment of the present invention.

As shown in FIG. 1, a chuch mechanism 2 which can hold a pipe or a longitdinal work 1 is provided substantially in the center of a bending device 100. In the chuck mechanism 2, the outer periphery of the work 1 is held by chucks (not shown).

Figure 2:
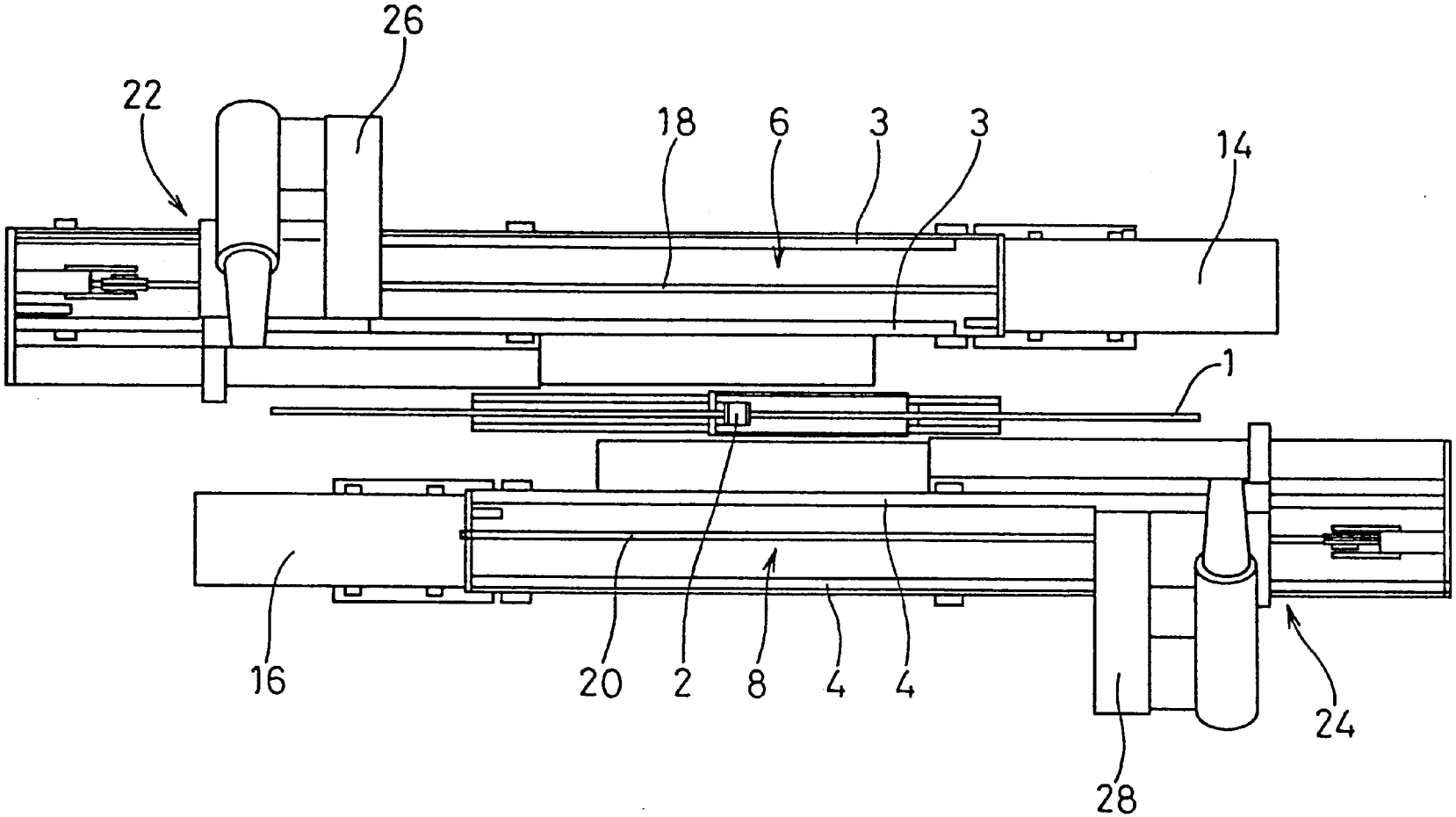
FIG. 2 is a plan view of the bending device.

As shown in FIG. 2, tracks 6 and 8 each with two rails 3, 4 laid thereon are arranged in parallel with the work 1 held by the chuck mechanism 2 and on opposite sides of the held work 1. Moving bases 10, 12 are laid on the rails 3, 4 in such a manner that they can move along the rails 3, 4.

The moving bases 10, 12 are moved along the tracks 6, 8 via chains 18, 20 which are rotated by drive mechanisms 14, 16 disposed on ends of the tracks 6, 8, respectively. The moving bases 10, 12, the tracks 6, 8 and the drive mechanisms 14, 16 form first and second moving mechanisms 22, 24.

First and second joint type robots 26, 28 are mounted on the moving bases 10, 12, respectively. The joint type robots 26, 28 are the same in structure, and disposed on the moving bases 10, 12 symmetrically to each other on sides of the chuck mechanism 2.

Figure 3:
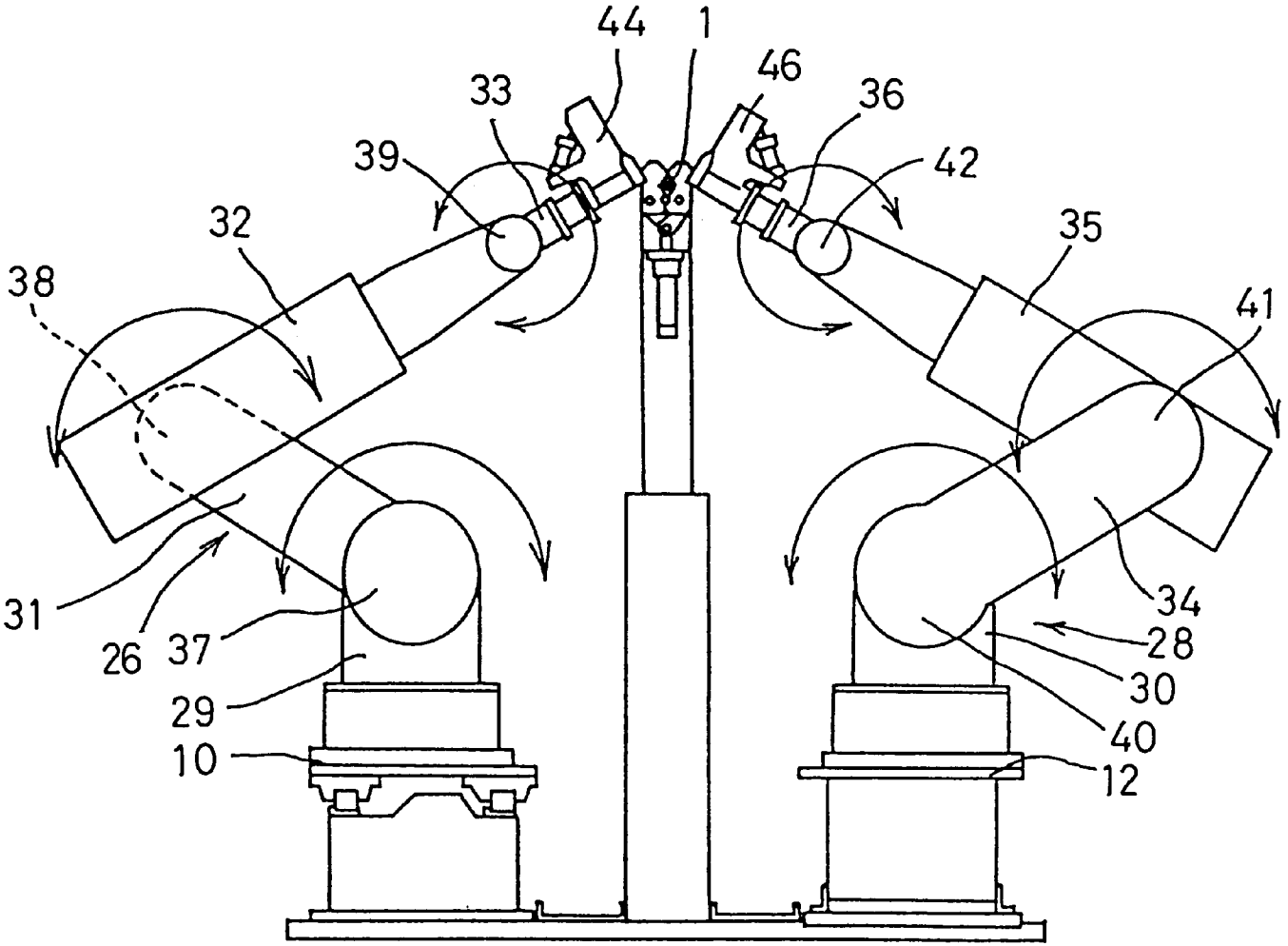
FIG. 3 is an enlarged side view of the bending device.

As shown in FIG. 3, the first or second joint type robot 26, 28 is provided with a base portion 29, 30 fixed on the moving base 10, 12, three arms 31 to 33, 34 to 36, and three joints 37 to 39, 40 to 42 connecting the base portions 29, 30 to the arms 31 to 33, 34 to 36 and rotating around axes parllel with the axial direction of the work 1.

First and second bending mechanisms 44, 46 are attached to the tip-end arms 33, 36 of the first and second joint type robots 26, 28, respectively. Since the first and second bending mechanisms 44, 46 are the same in structure, the first bending mechanism 44 attached to the first joint type robot 26 will be described in detail.

Figure 4:
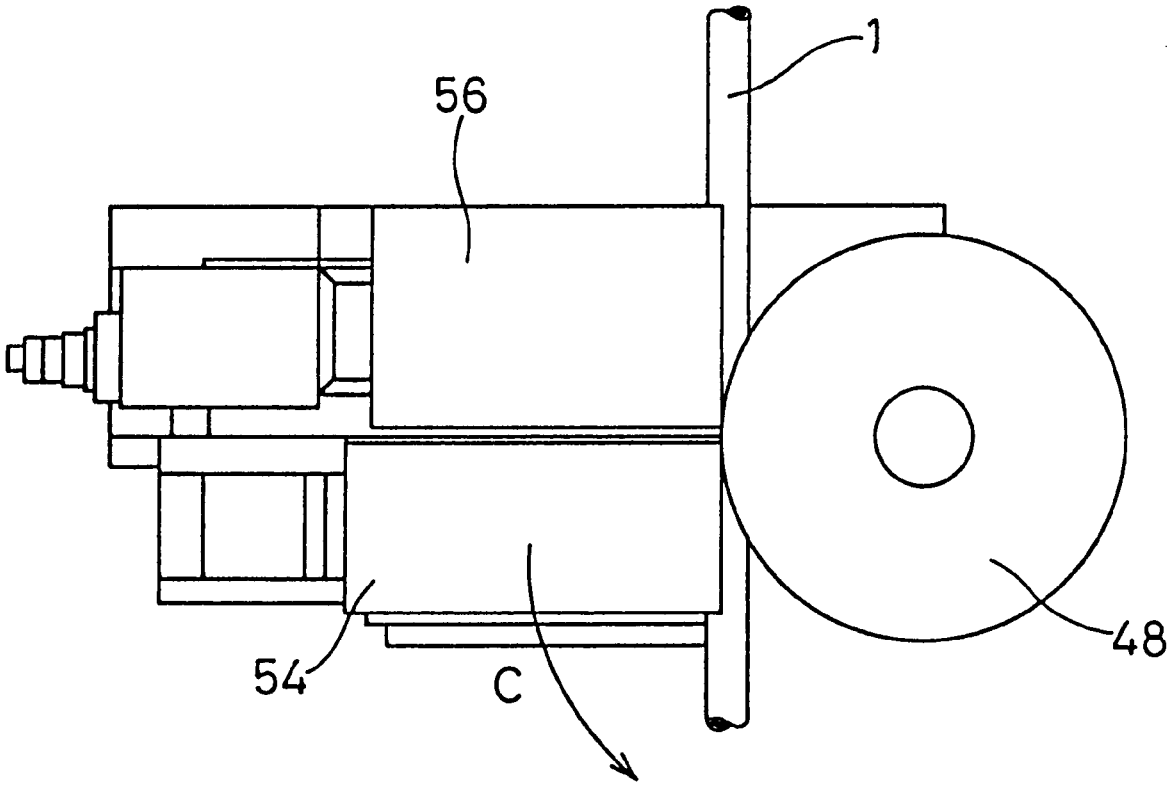
FIG. 4 is an enlarged plan view of a first bending mechanism of the bending device.
Figure 5:
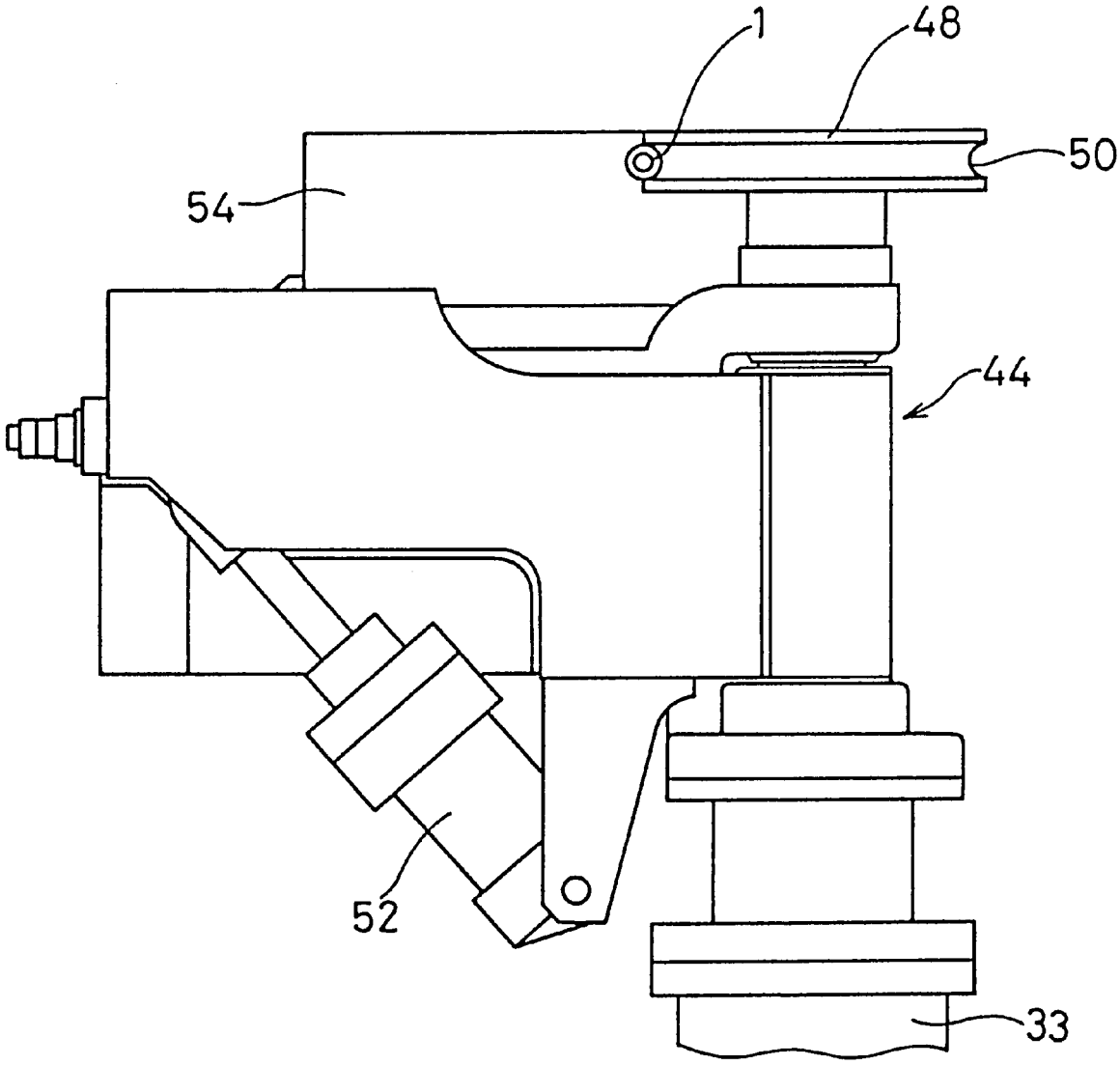
FIG. 5 is an enlarged side view of the first bending mechanism.

As shown in FIGS. 4, 5, in the first bending mechainism 44, a shaft of a bending die 48 is coaxially provided in the extended axial direction of the arm 33, and a groove 50 is formed in the outer periphery of the bending die 48 in accordance with the bending radius.

Moreover, a clamping die 54 is provided. The clamping die 54 is operated by a cylinder 52 to move toward the bending die 48 and hold the work 1 together with the bending die 48. The clamping die 54 is constracted to perform so-called compression bending by rotating around the bending die 48 while the work 1 is held with the bending die 48. A pressure die 56 is also provided adjacent to the lamping die 54 for receiving reaction at the time of bending. FIG. 5 shows that the bending mechanism 44 is set upright.

Figure 6:
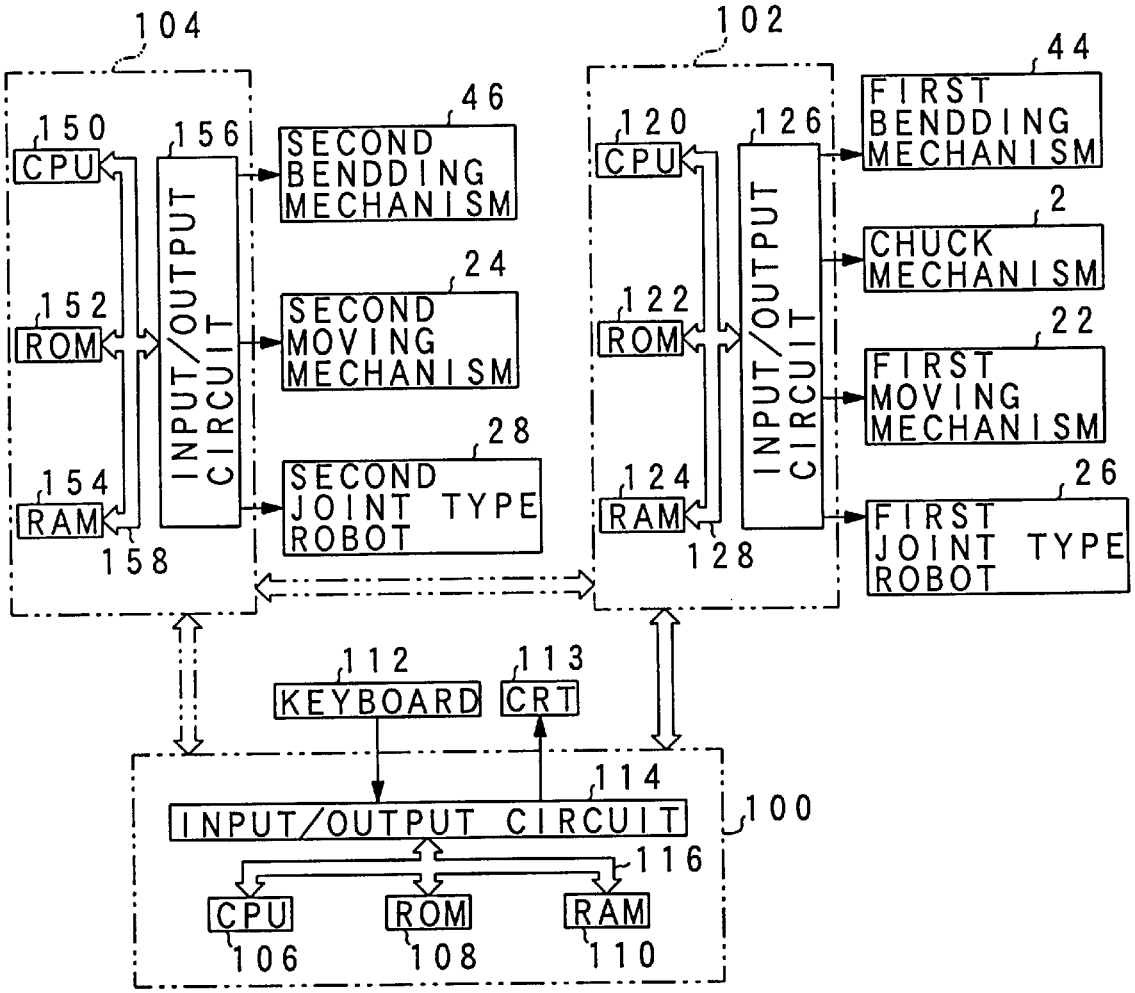
FIG. 6 is a block diagram schematically showing a control section of the bending device.

As shown in FIG. 6, the bending device 100 is operated and controlled by a controller or host computer 100, a first control device 102 and a second control device 104 to perform bending of the work 1. In the host computer 100, a logic circuit is mainly constituted of CPU 106, ROM 108 and RAM 110, and interconnected via a common bus 116 with an input/output circuit 114 for performing input/output with a keyboard 112 and a display 113.

In the embodiment, design data is entered into the host computer 100 via the keyboard 112 by an operator. Programs prepared for operating the first and second joint type robots 26, 28 are transmitted to the first and second control devices 102, 104 from the host computer 100, respectively.

In the first control device 102, a logic circuit is mainly constituted of CPU 120, ROM 122 and RAM 124, and interconneted via a common bus 128 with an input/output circuit 126 for performing input/output with an outside servo motor, and the like.

Signals are transmitted to the CPU 120 via the input/output circuit 126 from the first bending mechanism 44, the chuck mechanism 2, the first moving mechanism 22 and the first joint type robot 26. On the other hand, based on the data, signals and data in ROM 122 and RAM 124, the CPU 120 outputs drive signals or operating the first bending mechanism 44, the chuck mechanism 2, the first moving mechanism 22 and the first joint type robot 26 via the input/output circuit 126 to operate each mechanism.

On the other hand, the second control device 104 has substantially the same structure. A logic circuit is mainly constituted of CPU 150, ROM 152 and RAM 154, and interconnected via a common bus 158 with an input/output circuit 156 for performing input/output with an outside servo motor, and the like.

Signals are tranmitted to the CPU 150 via the input/output circuit 156 from the second bending mechanism 46, the second moving mechanism 24 and the second joint type robot 28. On the other hand, based on the data, signals and data in ROM 152 and RAM 154, the CPU 150 outputs drive signals for operating the second bending mechanism 46, the second moving mechanism 24 and the second joint type robot 28 via the input/output circuit 156 to operate each mechanism.

The operation of the bending device according to the embodiment will next be descrbed.

Figure 8:
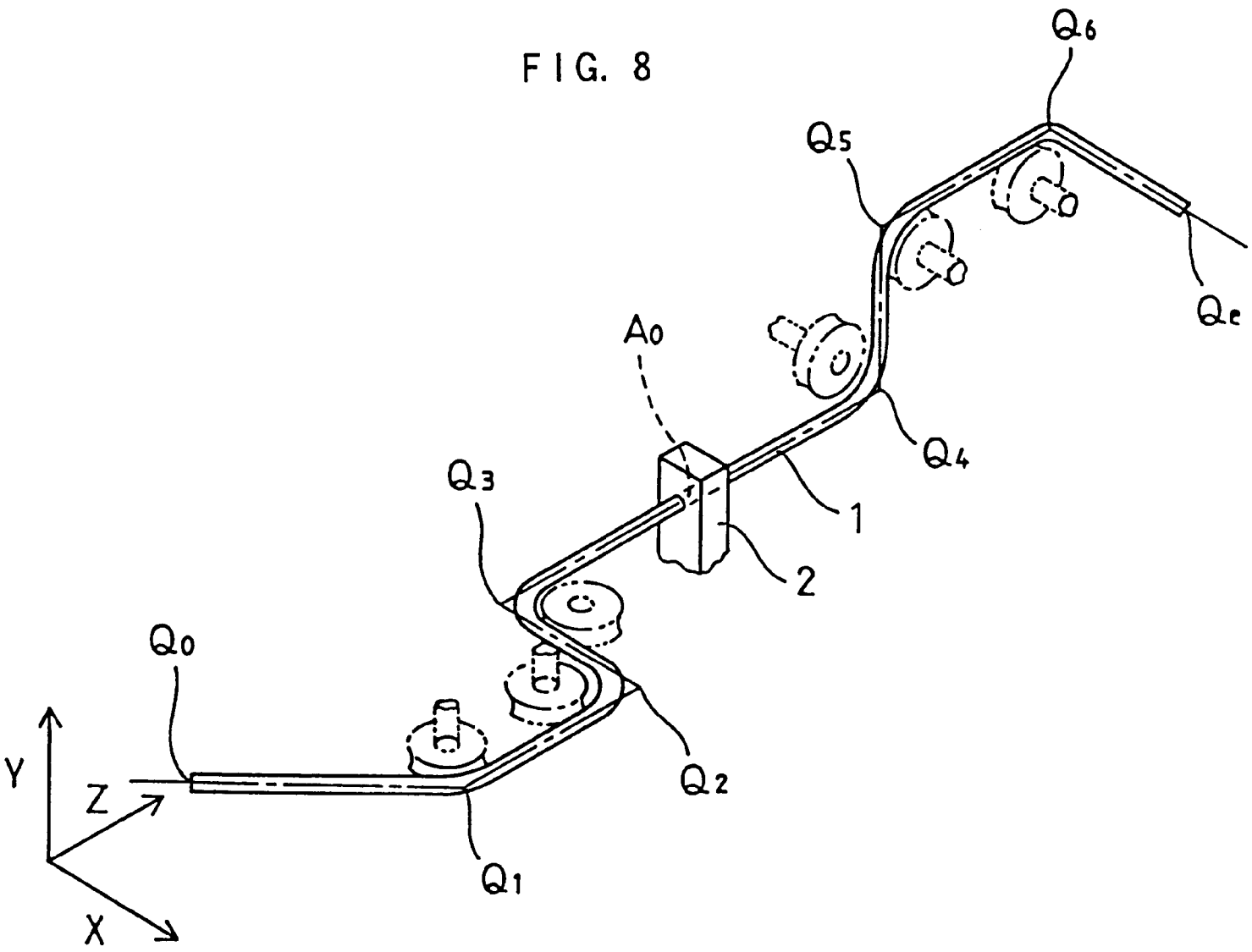
FIG. 8 is a perspective view of a work bent/worked by the bending device.
Figure 9A:
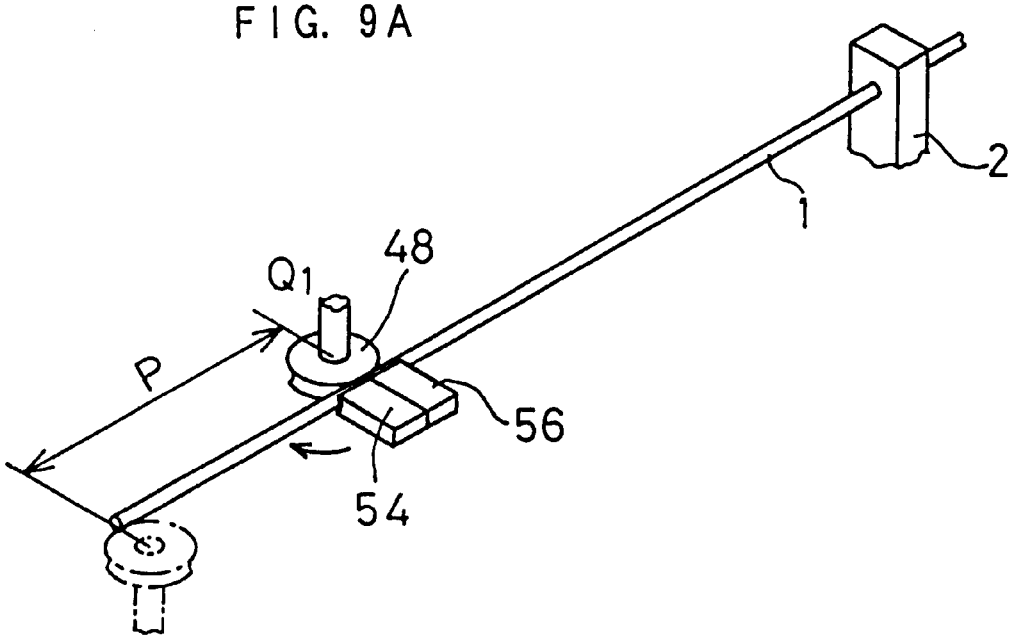
FIGS. 9A to 9C are explanatory views of a bending process by a first joint type robot of the bending device.

First, when the work 1 is bent into a shape shown in FIG. 8, a dividing point A0 substantially in the center of the longitudinal work 1 is grasped by the chuck mechanism 2. Subsequently, after the moving bases 10, 12 are moved to move the first and second joint type robots 26, 28 to predeternmined positions, operation is performed as preset For example, as shown in FIG. 9A, for the first joint type robot 26, the joints 37 to 39 are rotated, the first bending mechanism 44 is inverted, and the bending die 48 is moved in such a manner that the inner surface of the groove 50 of the bending die 48 abuts on the outer surface of the work 1. In this case, the joints 37 to 39 are rotated to turn the groove 50 of the bending die 48 in the bending direction of the work 1.

Subsequently, the clamping die 54 of the first bending mechanism 44 is moved, and the work 1 is held by the bending die 48 and the clamping die 54. After the pressure die 56 abuts on the work 1, the clamping die 54 is rotated around the bending die 48 by the predetermined angle as shown by an arrow C in FIG. 4, and the work 1 is bent.

After the clamping die 54 is rotated only by the set angle to bend the work 1, the clamping die 54 and the pressure die 56 are moved to release the work 1. Additionally, the same operation is performed in the second bending mechanism 46 of the second joint type robot 28, and the work 1 is bent.

Figure 9B:
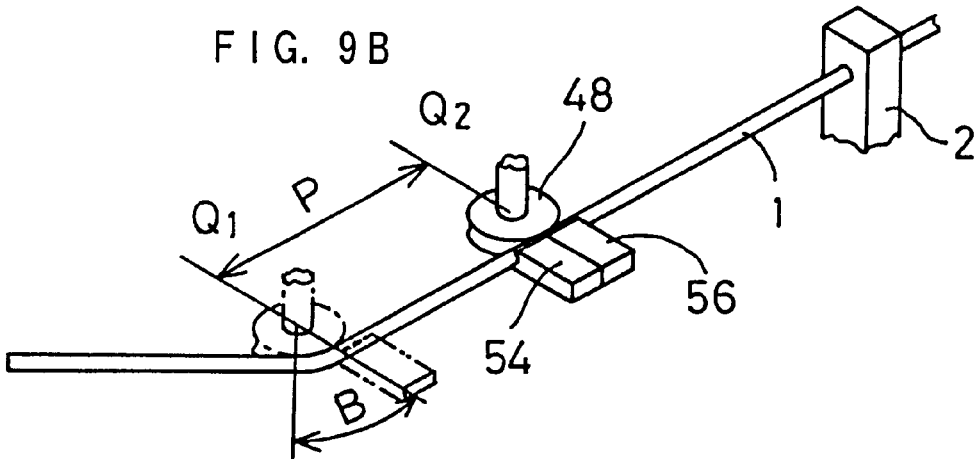

After the bending of one place is completed, the drive mechanism 14 is operated again. As shown in FIG. 9B, the moving base 10 is moved toward the chuck mechanism 2 until the next bending position is reached. After the moving base 10 is moved to the bending position, the work 1 is bent by the first bending mechanism 44 as described above.

Figure 9C:
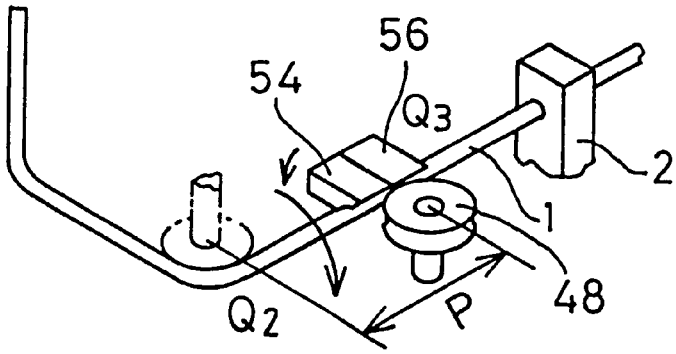

Furthermore, as shown in FIG. 9C, the first joint type robot 26 is moved to the next bending position, the joints 37 to 39 are rotated, and the first bending mechanism 44 is set up vertical. Subsequently, the first bending mechanism 44 is operated to bend the work 1. In this manner, the work 1 held by the chuck mechanism 2 is successively bent from its end toward the chuck mechanism 2.

When the moving base 10 is moved from bending position Q2 of FIG. 9B to bending position Q3 of FIG. 9C, the attitude of the first bending mechanism 44 needs to be changed from the inverted state to the upright state. In this case, the drive mechanism 14 is operated to move the moving base 10 from the bending position Q2 of FIG. 9B to the bending position Q3 of FIG. 9C, the joints 37 to 39 rotated, and the attitude of the first bending mechanism 44 is changed as shown in FIGS. 10A to 10C.

Figure 10A:
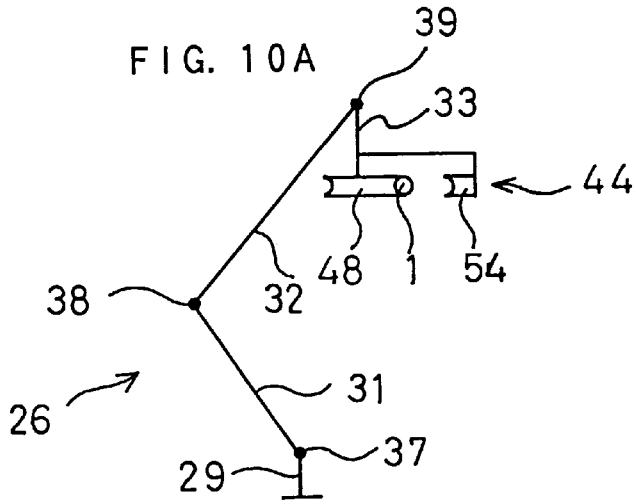
FIGS. 10A to 10C are explanatory views of a change in attitude of the bending mechanism when the bending device performs the bending process.
Figure 10B:
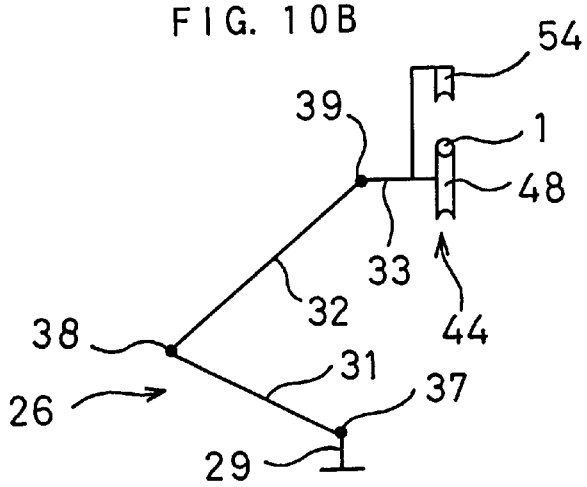
Figure 10C:
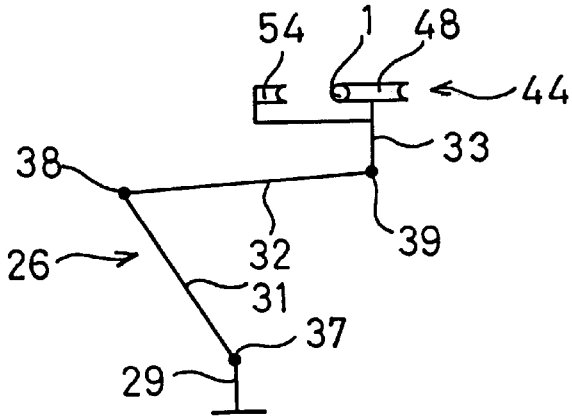
Figure 11:
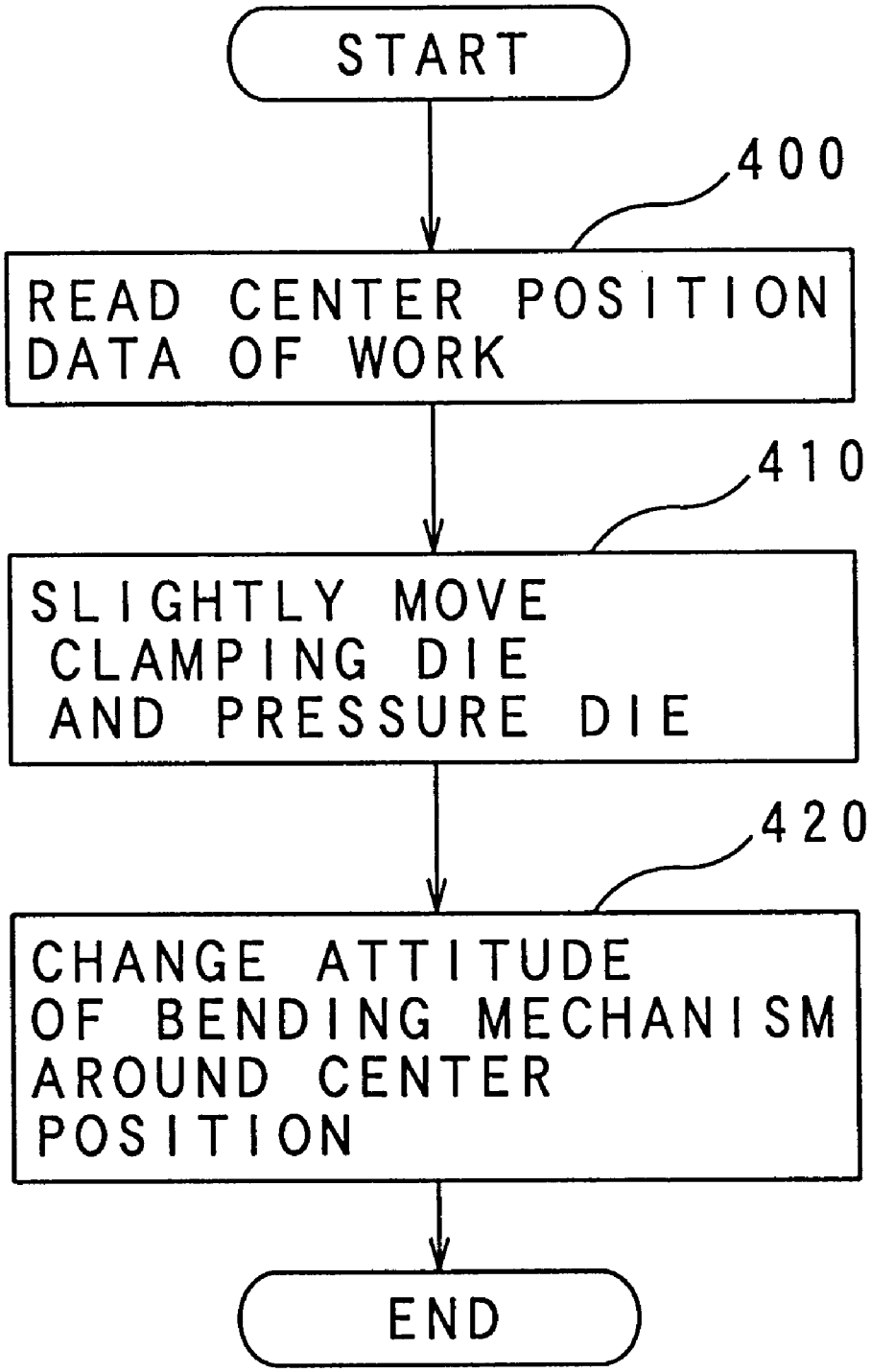
FIG. 11 is a flowchart of a control step for changing the attitude of the bending mechanism.

When the first bending mechanism 44 is inverted as shown in FIG. 10A, the attitude of the first bending mechanism 44 is changed by rotating the joints 37 to 39 while the work 1 is remained between the bending die 48 and the clamping die 54. The attitude shown in FIG. 10A is changed to a state in which the first bending mechanism 44 is directed laterally as shown in FIG. 10B, and further changed to a state in which the first bending mechanism 44 is set upright. While the attitude is changed, the joints 37 to 39 are rotated in such a manner that the work 1 is kept between the bending die 48 and the clamping die 54. The attitude change is controlled according to steps shown in the flowchart of FIG. 11. At step 400,the data of the center position of the work 1 is read. Subsequently, at step 410, the clamping die 54 and the pressure die 56 are slightly moved away from the work 1. Subsequently, at step 420, based on the obtained center position data, the attitude of the bending mechanism is changed by rotating te bending die 48, the clamping die 54 and the pressure die 56 around the center position.

After the bending process is completed in this manner, the first bending mechanism 44 is moved to the next bending position without being retracted from the work 1. Additionally, the attitude of the first bending mechanism 44 is changed in acordance with the next bending direction. Therefore, the tact time is shortened. The same applies to the second joint type robot 28.

Figure 7:
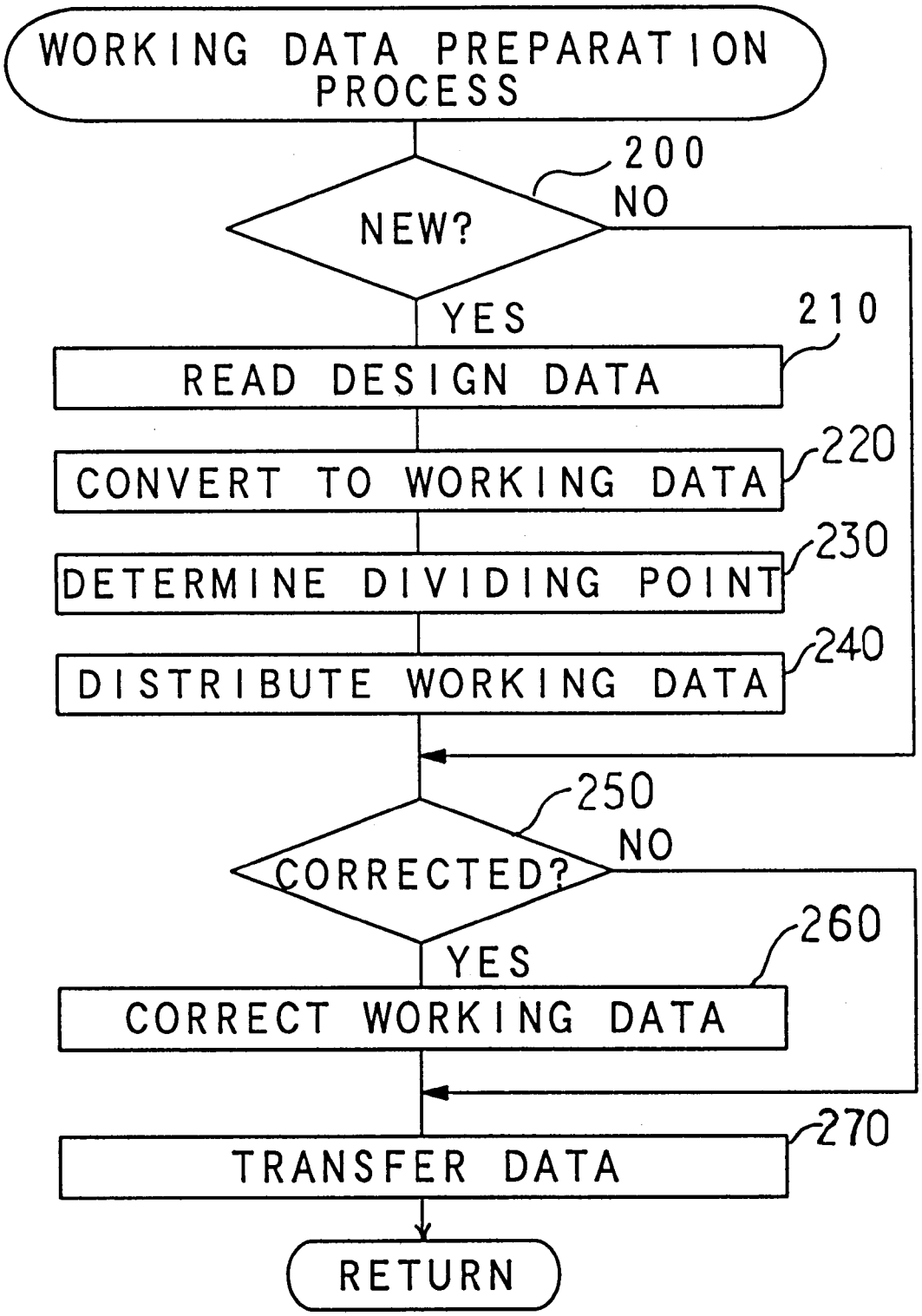
FIG. 7 is a flowchart showing a process of preparing working data in the control second of the bending device.

Subsequently, the process of preparing the working data in the control circuit of the embodiment will next be described with reference to the flowchart of FIG. 7.

The bending of the work 1 is performed based on the design data of the work 1. For example, when the work 1 is worked into the shape shown in FIG. 8, the design data is given as the three-dimensional coordinate data of an orthogonal coordinate system. The design data is entered into the host computer 100 via the keyboard 112.

Moreover, the design data is the coordinate data of the center line of the work 1. For the bent place, the intersection of the centerlines of straight portions of the work 1 is regarded as the bending point, and XYZ coordinate of the bending point is used as the design data. The coordinate data of both ends of the work 1 is also entered as the design data. In the example of FIG. 8, as shown in Table 1, one end of the work 1 is a bending point Q0 (origin), the other end is a bending point Qe, and the design data of bending points Q1 to Q6 between Q0 and Qe is entered.

TABLE 1

| BENDING | DESIGN DATA | | |
|---|---|---|---|
| POINT | X | Y | Z |
| Q0 | 0 | 0 | 0 |
| Q1 | 212 | 0 | 212 |
| Q2 | 212 | 0 | 412 |
| Q3 | 0 | 0 | 412 |
| Q4 | 0 | 0 | 912 |
| Q5 | 0 | 212 | 912 |
| Q6 | 0 | 212 | 1112 |
| Qe | 0 | 0 | 1324 |

When the working data preparation process is started, it is first determined at step 200 whether or not the design data of a new work 1 is prepared. It is determined whether or not the work 1 is new in response to input from the keyboard 112. When the work 1 is new, the design data is read at step 210.

Subsequently, the design data is converted to the working data constituted of a feeding pitch P between bending points Q, bending direction angle R and bending angle B at step 220. The working data is obtained, for example, when the work 1 is bent/worked successively from the bending point Q0 toward the other-end bending point Qe only by the first joint type robot 26.

The feeding pitch P indicates a feeding amount of the first joint type robot 26 determined by considering the bending radius (30 in Table 1) along the axial direction (Z-axis direction in FIG. 8) of the work 1 by the first moving mechanism 22. Moreover, the bending direction angle R is an angle indicating the attitude of the first and second bending mechanisms 44, 46, while the bending angle B indicates an angle by which the work 1 is bent, i.e, a rotating angle of the clamping die 54 in the direction of the arrow C shown in FIG. 4. The values of the working data are calculated in an increment manner.

After the design data is converted to the working data, a process of determining the dividing point A0 is performed at step 230. The dividing point A0 is a point of the work 1 held by the chuck mechanism 2. The work 1 is bent/worked on opposite sides of the dividing point A0 by the first joint type robot 26 and the second joint type robot 28. As shown in FIG. 8, substantially the center of the straight portion of the work 1 having a length enough to be held by the chuck mechanism 2 is selected as the dividing point A0.

Subsequently, the working data is distributed to the first and second joint type robots 26, 28 at the dividing point A0 as a reference at step 240. As shown in Table 2, the working of the bending points Q1 to Q3 between the one-end bending point Q0 and the dividing point A0 is allotted to the first joint type robot 26.

TABLE 2

| BENDING | WORKING DATA | | |
|---|---|---|---|
| POINT | P | R | B |
| Q1 | 0 | 0 | 45 |
| Q2 | 183.03 | 0 | 90 |
| Q3 | 188 | −180 | 90 |

Since the second joint type robot 28 moves in the direction reverse to the direction of the first joint type robot 26, as shown in Table 3 the working of the bending points Q6 to Q4 between the other-end bending point Qe and the dividing point A0 is allotted to the second joint type robot 28. Therefore, for the second joint type robot 28, the design data is converted to the working data from the movement from the bending point Q6 to the bending point Q4.

TABLE 3

| BENDING | WORKING DATA | | |
|---|---|---|---|
| POINT | P | R | B |
| Q6 | 0 | 0 | 45 |
| Q5 | 183.03 | 0 | 90 |
| Q4 | 188 | −180 | 90 |

After the conversion, it is determined at step 250 whether or not the data is to be corrected. It is determined in accordance with the input from the keyboard 112 whether or not the data is to be corrected. When it is determined that the data is not corrected, the process at and after step 270 is executed, so that the working data is transferred to the first and second control devices 102, 104 from the host computer 100. After the data is transferred, the control process is once completed, and the work 1 is bent/worked based on the transferred working data.

After the work 1 is bent by the working data, the feeding pitch P, bending direction angle R and bending angle B of each of the bending points Q1 to Q6 are measured. Subsequently, when the shape of the bent work 1 is different from the working data, the feeding pitch P, bending direction angle R and the bending angle B in the working data shown in Table 2 or 3 are directly corrected by an operator.

In the working data preparation process, when it is determined at the step 200 that the work 1 is not new and it is determined at the step 250 that the data is to be corrected, then the working data is corrected at step 260. For example, Tables 2, 3 are indicated on the display 113, and the working data of Tables 2, 3 are corrected based on the input from the keyboard 112.

Specifically, when the pitch between the bending points Q2 and Q3 is different from the working data, the feeding pitch P of the bending point Q3 in the working data shown in table 2 is corrected. The correction amount is determined by measuring the pitch between the bending points Q2 and Q3 with a ruler or the like, and the feeding pitch P is increased/decreased. Even when the feeding pitch P is corrected, the feeding pitches P of the other bending points Q undergo no influence.

The same applies to the bending diction angle R and the bending angle B. The data of each bending point Q can be corrected without influencing the data of the other bending points. Addiionally, the process of the steps 200 to 220 is executed by the working data preparing means, and the process of the steps 250 and 260 is executed by the correcting means. Moreover, the process of the step 230 is executed by the dividing point determining means.

An unloading control process performed after the bending process is completed will next be described with reference to FIGS. 12, 13 and 14A to 14E.

Figure 12:
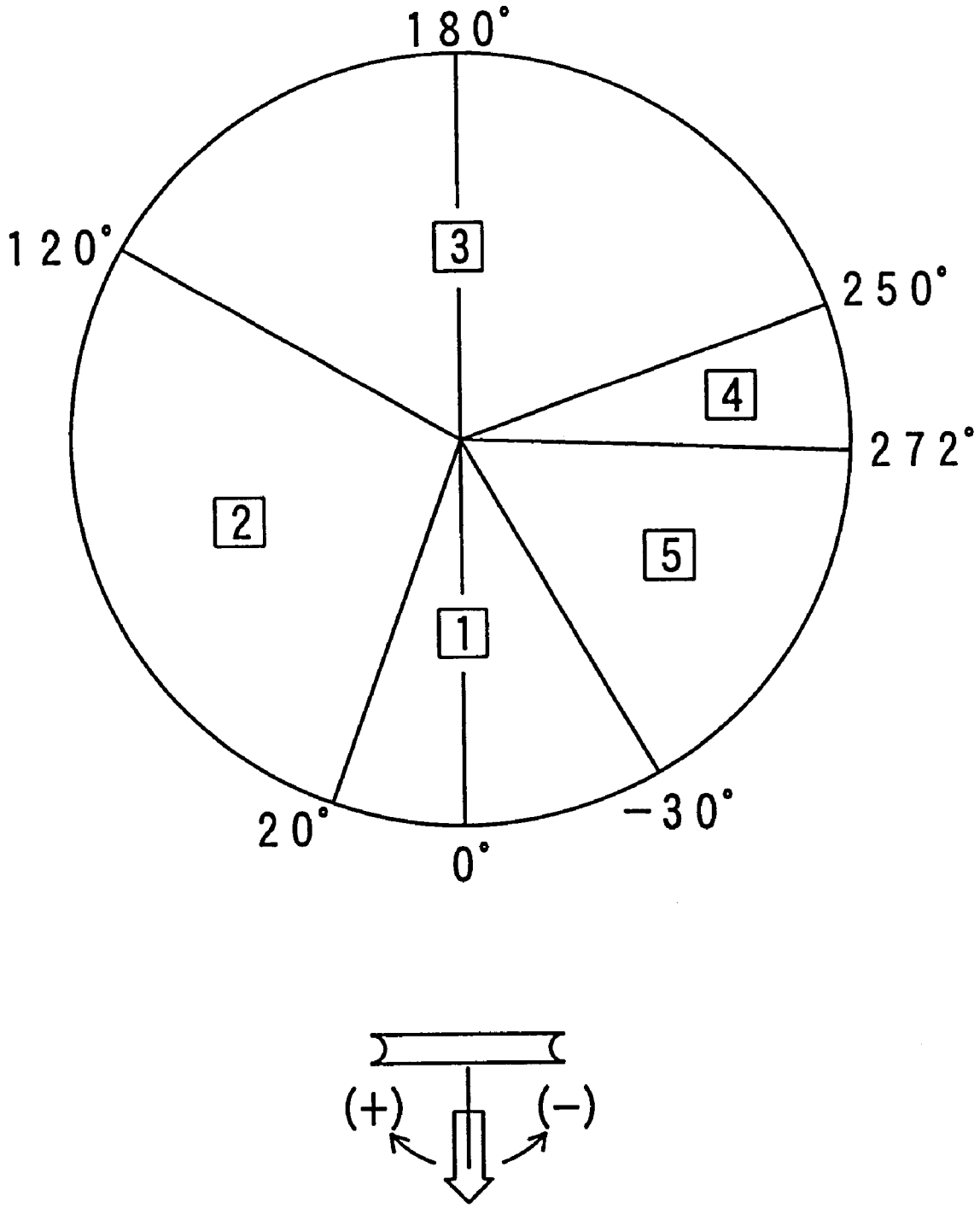
FIG. 12 is an explanatory view of a twist angle of the bending mechanism.

As shown in FIG. 12, when the first bending mechanism 44 is in its upright state and the center axis of the bending die is in a vertical direction, a twist angle is set to zero degree, a rotation angle of a clockwise direction is set to a positive angle, and a rotation angle of a counterclockwise direction is set to a negative angle. The twist angle indicates an angle of the first bending mechanism 44 when the work 1 is finally bent/worked by the first bending mechanism 44 of the first joint type robot 26. A first pattern processing is performed when the twist angle is in the range of −30 to 20 degrees, a second pattern processing is performed when the twist angle is in the range of 20 to 120 degrees, a third pattern processing is performed when the twist angle is in the range of 120 to 250 degrees, a fourth pattern processing is performed when the twist angle is in the range of 250 to 272 degrees, and a fifth pattern processing is performed when the twist angle is in the range of −30 to −90 degrees.

Figure 13:
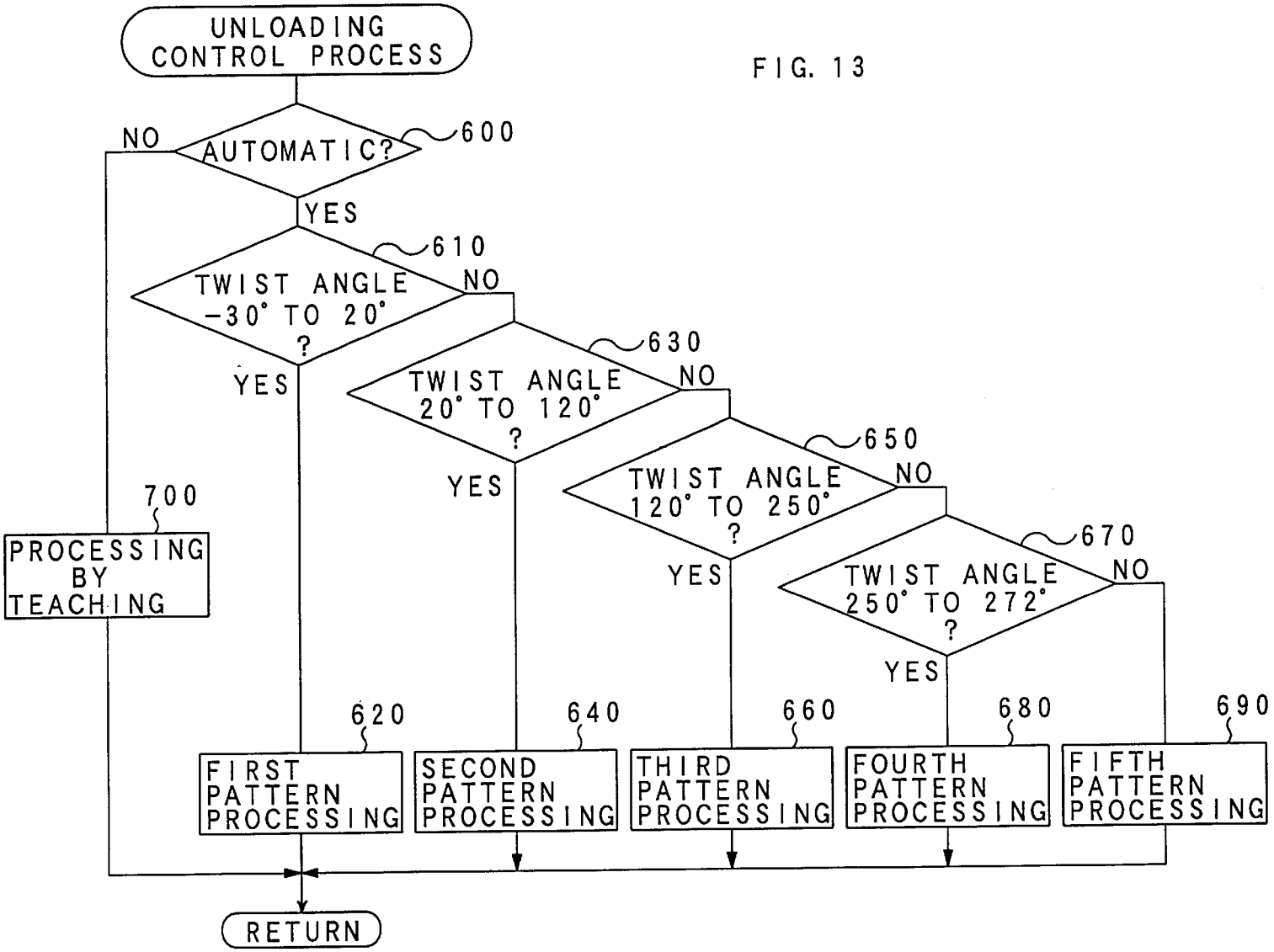
FIG. 13 is a flowchart of an unloading control process performed in the bending device of the embodiment.
Figure 14A:
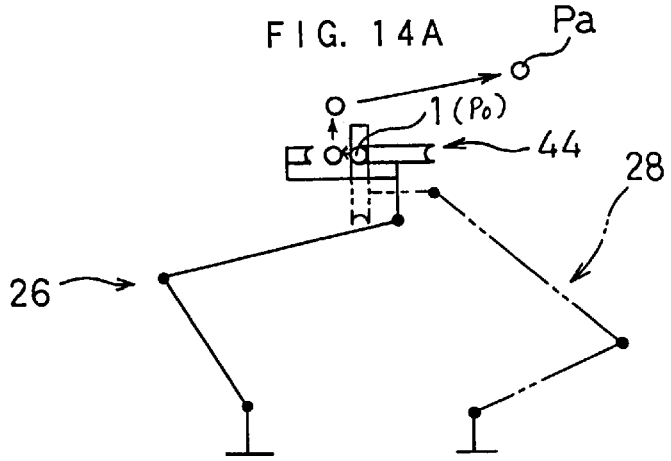
FIGS. 14A to 14E are explanatory views of a discharge path of the work at the time of unloading.
Figure 14B:
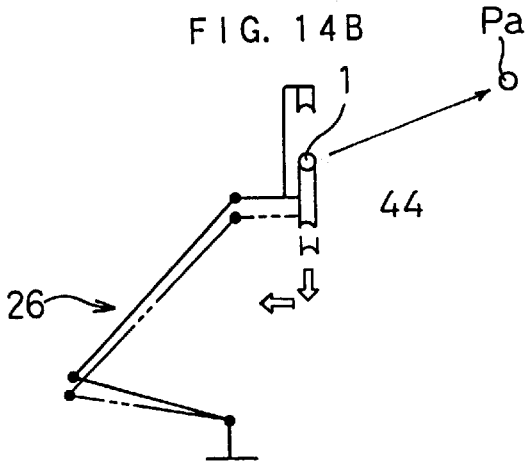

Referring to FIG. 13, first, when the bending process is completed, it is determined at step 600 whether or not the work 1 is automatically unloaded. It is preset via the keyboard 112 whether or not the unloading is automatic. When it is determined that the work 1 is automatically unloaded, the twist angle of the first bending mechanism 44 of the first joint type robot 26 is determined at steps 610, 630, 650 and 670. In FIG. 14A the first joint type robot 26 is shown by a solid line, while the second joint type robot 28 is shown by a two-dot chain line. Since FIGS. 14B to 14E show only the first joint type robot 26, two-dot chain lines in these drawings also show the first joint type robot 26. In FIGS. 14B to 14B, the movement of the first joint type robot 26 is shown by double-line arrows.

First, it is determined at step 610 whether or not the twist angle of the first bending mechanism 44 is in the range of −30 to 20 degrees. When the angle is in the range, the first pattern processing is performed at step 620. As shown in FIG. 14A, in order to remove the work 1 held by the second bending mechanism 46 from the groove of the bending die of the first bending mechanism 44, the work 1 in a position Po inside the groove is horizontally moved in a direction shown by an arrow by the second joint type robot 28 to substantially the middle position between the clamping die and the bending die. Subsequently, after the work 1 is moved upward by the second joint type robot 28 and extracted from bending mechanism 44, the work 1 is moved toward unloading position Pa by the second joint type robot 28. In the first pattern processing, the first joint type robot 26 does not move.

On the other hand, when it is determined at step 630 that the twist angle of the first bending mechanism 44 is in the range of 20 to 120 degrees as shown in FIG. 14B, the second pattern processing is performed at step 640. First, the first joint type robot 26 is moved downward as shown by a two-dot chain line in such a manner that the work 1 is positioned in the middle of the bending die and the clamping die of the first bending mechanism 44, while the work 1 is held by the second joint type robot 28. Thereafter, in order to remove the work 1 from the first bending mechanism 44, after the first joint type robot 26 is horizontally moved toward the left, the work 1 is moved toward the unloading position Pa by the second joint type robot 28.

Figure 14C:
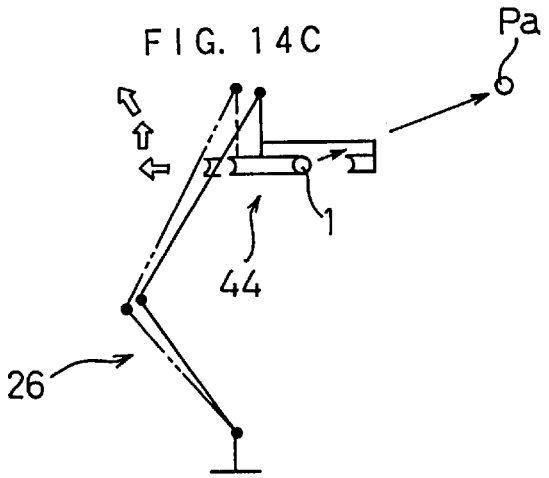

Moreover, when it is determined at step 650 that the twist angle of the first bending mechanism 44 is in the range of 120 to 250 degrees as shown in FIG. 14C, the third pattern processing is executed at step 660. The first joint type robot 26 is moved toward the left as shown by the two-dot chain line in such a manner that the work 1 is positioned between the bending die and the clamping die of the first bending mechanism 44, while the work 1 is held by the second joint type robot 28. Thereafter, in order to disengage the work 1 from the first bending mechanism 44, the first joint type robot 26 is moved upward, and further rotated in the counterclockwise direction. The first joint type robot 26 is thus positioned not to interfere with the unloading path of the work 1. Subsequently, the work 1 is moved toward the unloading position Pa by the second joint type robot 28.

Figure 14D:
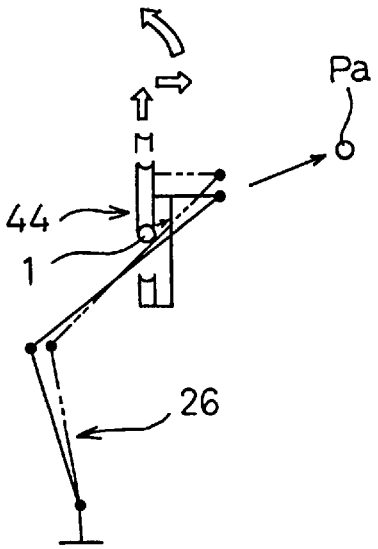

When it is determined at step 670 that the twist angle of the first bending mechanism 44 is in the range of 250 to 272 degrees as shown in FIG. 14D, the fourth pattern processing is executed at step 680. The first joint type robot 26 is moved upward as shown by the two-dot chain line in such a manner that the work 1 is positioned in the middle of the bending die and the clamping die of the first bending mechanism 44, while the work 1 is held by the second joint type robot 28. Thereafter, in order to disengage the work 1 from the first bending mechanism 44, the first joint type robot 26 is moved to the right, and further rotated in the counterclockwise direction. The first joint type robot 26 is thus positioned not to interfere with the unloading path of the work 1. Subsequently, the work 1 is moved toward the unloading position Pa by the second joint type robot 28.

Figure 14E:
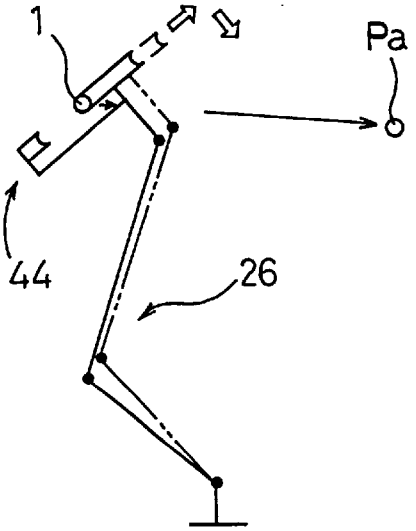

Furthermore, when the twist angle of the first bending mechanism 44 is outside the aforementioned range as shown in FIG. 14E, the fifth pattern processing is executed at step 690. For example, when the twist angle of the first bending mechanism 44 is −35 degrees, the first joint type robot 26 is moved upward to the right as shown by the two-dot chain line such a manner that the work 1 is positioned in the middle of the bending die and the clamping die of the first bending mechanism 44, while the work 1 is held by the second joint type robot 28. Thereafter, in order to disengage the work 1 from the first bending mechanism 44, the first joint type robot 26 is moved downward to the right. The first joint type robot 26 is thus positioned not to interfere with the unloading path of the work 1. Subsequently, the work 1 is moved toward the unloading position Pa by the second joint type robot 28.

As described above, there are limited types of patterns for moving the work 1 to the unloading position Pa from the position P0, where the work 1 is fit in the groove, in accordance with the twist angle of the first bending mechanism 44. The pattern is selected in accordance with the twist angle of the first bending mechanism 44, and the work 1 is moved to the unloading position Pa by the second joint type robot 28.

On the other hand, when it is detertermined at step 600 that the unloading is not automatic, a processing by teaching is executed at step 700. Specifically, a path for moving the first bending mechanism 44 by the first joint type robot 26 and moving the work 1 to the unloading position Pa by the second joint type robot 28 is taught and stored.

At step 680, the first and seconnd joint type robots 26 and 28 remove the work 1 from the groove of the first bending mechanism 44 and move it to the inloading position Pa according to the taught and stored moving path. Additionally, the process of the steps 610 to 690 is executed by the automatic delivery controlling means, while the process of the step 700 is executed by the teaching delivery controlling means.

In the aforementioned embodiment, the moving pattern of the work 1 is determined in accordance with the twist angle of the first bending mechanism 44 in order to unload the work 1 by the second bending mechanism 46 without being interfered with by the first bending mechanism 44, but the first bending mechanism 44 and the second bending mechanism 46 may be operated in reverse. Specifically, while the work is held by one of the bending mechanisms, it is unloaded without interfering with the other bending mechanism.

Modifications of the invention herein disclosed will occur to a person skilled in the art and all such modification are deemed to be within the scope of the invention as defined by the appended claims.

What is claimed is:

1. A bending device for bending an elongated work piece, the bending device comprising:

a joint type robot having a remote tip end, a bending mechanism attached to the remote tip end of the joint type robot, the bending mechanism comprising a bending die, a clamping die, and a pressure die, the bending of the work piece is performed using the bending, clamping and pressure dies, and the joint type robot having at least three joints to facilitate moving the bending mechanism a desired distance along the work piece as well as facilitate rotation of the bending mechanism a desired angle relative to the work piece;

movement control means for moving the bending mechanism of the joint type robot along the work piece, while rotating each of the joints along the work piece to change an attitude of the bending mechanism and maintaining a condition in which the work piece remains located between the bending, clamping and pressure dies, the movement control means comprising:

reading means for reading coordinates of a middle point of the work piece when positioned between the bending, clamping and pressure dies;

rotation means for rotating the bending mechanism around the coordinates of the middle point read by the reading means, thereby changing an attitude of the bending mechanism; and robot driving means for driving the joint type robot so as to move the bending mechanism while maintaining the work piece positioned between the bending, clamping and pressure dies.

2. The bending device according to claim 1, wherein the movement control means further comprises moving means for moving the bending, clamping and pressure dies toward and away from the work piece.

3. The bending device according to claim 1, wherein the joint-type robot is supported by a movable base, and the movable base is supported on a track, and the movable base is coupled to a drive mechanism to facilitate moving the movable base along the track.

4. The bending device according to claim 3, wherein the joint-type robot has a first end of a first arm pivotally supported by the movable base and a first end of a second arm is pivotally connected to a remote second end of the first arm, and a first end of a third arm is pivotally connected to a remote second end of the second arm, and a remote second end of the third arm is attached to the bending mechanism, and the pivotally connections of the first arm, the second arm and the third arm all extend parallel to an axial direction of the work piece.

5. The bending device according to claim 1, wherein a support structure supports the bending device and a chuck mechanism, and the chuck mechanism releasably supports the work piece to facilitate bending of the work piece by the bending device.

6. The bending device according to claim 1, wherein a pressurized cylinder biases the clamping die toward engagement with the bending die to facilitate bending of the work piece during operation of the bending device.

7. The bending device according to claim 6, wherein the pressurized cylinder biases the pressure die toward engagement with the bending die to facilitate bending of the work piece during operation of the bending device.

8. A bending device for bending an elongated work piece, the bending device comprising:

a support structure supporting the bending device and a chuck mechanism, and the chuck mechanism releasably supporting a work piece to facilitate bending of the work piece by the bending device;

a joint type robot having a remote tip end, a bending mechanism attached to the remote tip end of the joint type robot, the bending mechanism comprising a bending die, a clamping die, and a pressure die, the bending of the work piece is performed using the bending, clamping and pressure dies, and the joint type robot having at least three joints to facilitate moving the bending mechanism a desired distance along the work piece as well as facilitate rotating the bending mechanism a desired angle relative to the work piece;

the joint-type robot being supported by a movable base, and the movable base being supported on a track and the movable base being coupled to a drive mechanism to facilitate moving the movable base along the track relative to the support structure;

movement control means for moving the bending mechanism of the joint type robot along the work piece, while rotating each of the joints to change an attitude of the bending mechanism and maintaining a condition in which the work piece remains located between the bending, clamping and pressure dies, the movement control means comprising:

reading means for reading coordinates of a middle point of the work piece when positioned between the bending, clamping and pressure dies;

rotation means for rotating the bending mechanism around the coordinates of the middle point read by the reading means, thereby changing an attitude of the bending mechanism; and robot driving means for driving the joint type robot so as to move the bending mechanism while maintaining the work piece positioned between the bending, clamping and pressure dies.

9. The bending device according to claim 8, wherein the joint type robot has a first end of a first arm pivotally supported by the movable base and a first end of a second arm is pivotally connected to a remote second end of the first arm, and a first end of a third arm is pivotally connected to a remote second end of the second arm, and a remote second end of the third arm is attached to the bending mechanism, and the pivotally connections of the first arm, the second arm and the third arm all extend parallel to an axial direction of the work piece.

10. The bending device according to claim 8, wherein a pressurized cylinder biases the clamping die toward engagement with the bending die to facilitate bending of the work piece during operation of the bending device.

11. The bending device according to claim 10, wherein the pressurized cylinder biases the pressure die toward engagement with the bending die to facilitate bending of the work piece during operation of the bending device.

12. The bending device according to claim 11, wherein the movement control means further comprises moving means for moving the bending, clamping and pressure dies toward and away from the work piece.

13. A bending device for bending an elongated work piece, the bending device comprising:

a support structure supporting the bending device and a chuck mechanism, and the chuck mechanism releasably supporting a work piece to facilitate bending of the work piece by the bending device;

a pair of joint type robots, each of the pair of joint type robots having a remote tip end, a bending mechanism attached to the remote tip end of each of the pair of joint type robots, the bending mechanism comprising a bending die, a clamping die, and a pressure die, the bending of the work piece is performed using the bending, clamping and pressure dies, and each of the pair of joint type robots having at least three joints to facilitate moving the bending mechanism a desired distance along the work piece as well as facilitate rotating the bending mechanism a desired angle relative to the work piece;

each of the pair of joint type robots being supported by a movable base, and each of the movable bases being supported on a track and each of the movable bases being coupled to a drive mechanism to facilitate moving the movable bases along the track relative to the support structure;

movement control means for separately moving the bending mechanism of each of the pair of joint type robots along the work piece, while rotating each of the joints to change an attitude of the bending mechanism and maintaining a condition in which the work piece remains located between the bending, clamping and pressure dies, the movement control means comprising:

reading means for reading coordinates of a middle point of the work piece when positioned between the bending, clamping and pressure dies;

rotation means for rotating the bending mechanism around the coordinates of the middle point read by the reading means, thereby changing an attitude of the bending mechanism; and robot driving means for driving the joint type robot so as to move the bending mechanism while maintaining the work piece positioned between the bending, clamping and pressure dies.

14. The bending device according to claim 13, wherein each of the pair of joint type robots has a first end of a first arm pivotally supported by one of the movable bases and a first end of a second arm is pivotally connected to a remote second end of the first arm, and a first end of a third arm is pivotally connected to a remote second end of the second arm, and a remote second end of the third arm is attached to one of the bending mechanisms, and the pivotally connections of the first arm, the second arm and the third arm of each of the pair of joint type robots all extend parallel to an axial direction of the work piece.

15. The bending device according to claim 14, wherein a pressurized cylinder biases the clamping die toward engagement with the bending die of each of the pair of joint type robots, to facilitate bending of the work piece during operation of the bending device.

16. The bending device according to claim 15, wherein the pressurized cylinder biases the pressure die toward engagement with the bending die of each of the pair of joint type robots, to facilitate bending of the work piece during operation of the bending device.

17. The bending device according to claim 16, wherein the pressurized cylinder further comprises moving means for moving the bending, clamping and pressure dies of the bending mechanism of each pair of joint type robots apart from the work piece.

18. The bending device according to claim 13, wherein a pressurized cylinder biases the clamping die toward engagement with the bending die of each of the pair of joint type robots, to facilitate bending of the work piece during operation of the bending device.

19. The bending device according to claim 18, wherein the pressurized cylinder biases the pressure die toward engagement with the bending die of each of the pair of joint type robots, to facilitate bending of the work piece during operation of the bending device.

20. The bending device according to claim 19, wherein the pressurized cylinder further comprises moving means for moving the bending, clamping and pressure dies of the bending mechanism of each pair of joint type robots apart from the work piece.

* * * * *